US006652366B2

(12) United States Patent
Dyer

(10) Patent No.: US 6,652,366 B2
(45) Date of Patent: Nov. 25, 2003

(54) DYNAMIC SLURRY DISTRIBUTION CONTROL FOR CMP

(75) Inventor: Timothy S. Dyer, Tempe, AZ (US)

(73) Assignee: Speedfam-IPEC Corporation, Chandler, AZ (US)

( * ) Notice: Subject to any disclaimer, the term of this patent is extended or adjusted under 35 U.S.C. 154(b) by 290 days.

(21) Appl. No.: 09/859,656

(22) Filed: May 16, 2001

(65) Prior Publication Data

US 2002/0173249 A1 Nov. 21, 2002

(51) Int. Cl.[7] ..... B24B 1/00

(52) U.S. Cl. ..... 451/60; 451/36; 451/41; 451/287; 451/288; 451/446

(58) Field of Search ..... 451/36, 41, 60, 451/287, 288, 446

(56) References Cited

U.S. PATENT DOCUMENTS

| | | | | |
|---|---|---|---|---|
| 4,593,716 A | | 6/1986 | Cesna | |
| 5,658,185 A | * | 8/1997 | Morgan, III et al. | 451/36 |
| 5,857,893 A | | 1/1999 | Olsen et al. | |
| 5,872,633 A | | 2/1999 | Holzapfel et al. | |
| 5,921,849 A | | 7/1999 | Kim et al. | |
| 6,280,297 B1 | * | 8/2001 | Tolles et al. | 451/41 |

OTHER PUBLICATIONS

U.S. patent application Ser. No. 09/705,222, Dyer filed Nov. 2, 2000.

U.S. patent application Ser. No. 09/618,398, Korovin filed Jul. 18, 2000.

U.S. patent application Ser. No. 09/559,905, Guha et al. filed Apr. 26, 2000.

U.S. patent application Ser. No. 09/525,736, Koppikar filed Mar. 14, 2000.

U.S. patent application Ser. No. 09/516,317, Olsen et al. filed Mar. 1, 2000.

* cited by examiner

*Primary Examiner*—Joseph J. Hail, III
*Assistant Examiner*—Shantese McDonald
(74) *Attorney, Agent, or Firm*—Ingrassia Fisher & Lorenz, P.C.

(57) ABSTRACT

The invention is a slurry distribution system for controlling the distribution of slurry across a top surface of a polishing pad. The polishing pad may be supported by a platen and be part of a polishing station in a chemical mechanical polishing tool. Two juxtaposed perforated manifolds below the polishing pads are used as the primary means of controlling the distribution of slurry. A motor is used to rotate at least one of the perforated manifolds until a desired pattern of aligned perforations below the polishing pad has been achieved. By initially creating the perforations in each manifold in a particular pattern, many different patterns of aligned perforations may be obtained. Patterns may advantageously be made possible that have concentrations of aligned perforations in the center, middle and/or periphery of the manifolds. The polishing pad will have a slurry distribution corresponding to the concentration of aligned perforations in the manifolds.

12 Claims, 7 Drawing Sheets

DYNAMIC SLURRY DISTRIBUTION CONTROL FOR CMP

TECHNICAL FIELD

The invention relates to semiconductor manufacturing and more specifically to a method and apparatus for controlling the delivery of slurry through a polishing pad in a chemical mechanical polishing (CMP) tool.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness.

Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing process steps that create the integrated circuitry or interconnects on the wafer. A considerable amount of effort in the manufacturing of modern complex, high density multilevel interconnects is devoted to the planarization of the individual layers of the interconnect structure. Nonplanar surfaces create poor optical resolution of subsequent photolithography processing steps. Poor optical resolution prohibits the printing of high-density lines. Another problem with nonplanar surface topography is the step coverage of subsequent metalization layers. If a step height is too large there is a serious danger that open circuits will be created. Planar interconnect surface layers are required in the fabrication of modem high-density integrated circuits. To this end, chemical-mechanical polishing (CMP) tools have been developed to provide controlled planarization of both structured and unstructured wafers.

CMP consists of a chemical process and a mechanical process acting together, for example, to reduce height variations across a dielectric region, clear metal deposits in damascene processes or remove excess oxide in shallow trench isolation fabrication. The chemical-mechanical process is achieved with a liquid medium containing chemicals and abrasive particles (commonly referred to as slurry) that react with the front surface of the wafer while it is mechanically stressed during the planarization process.

In a conventional CMP tool for planarizing a wafer, a wafer is secured in a carrier connected to a shaft. Pressure is exerted on the back surface of the wafer by the carrier in order to press the front surface of the wafer against the polishing pad in the presence of slurry. The wafer and/or polishing pad are then moved in relation to each other via motor(s) connected to the shaft and/or platen in order to remove material in a planar manner from the front surface of the wafer. Various combinations of motions are known for moving the wafer and polishing pad in relation to each other. For example, the wafer is commonly rotated or held stationary and the polishing pad is moved in either a linear, rotational or orbital manner.

A common problem in CMP is for the wafer to polish in a nonplanar manner. The wafer typically has a "bull's-eye" pattern with the center of the wafer being polishing either faster or slower than the circumference. The polishing rate tends to be uniform within concentric bands, but not across the entire surface of the wafer. Numerous attempts have been made to remedy this problem with only partial success. This problem has recently worsened as some of the slurries used to planarize wafers with copper thin films result in nonuniform material removal with limited process control.

One attempted solution to solve the problem when the center is being polished too slowly is to move the edge of the wafer over the edge of the polishing pad. This will slow the removal rate of material at the edge of the wafer to more closely match the removal rate at the center of the wafer. This solution is relatively inexpensive, but has several problems. One problem is that this solution is not able to compensate for the center fast situation. In addition, front-reference carriers (those supporting the wafer by air or a membrane) tend to break or lose control of the wafer when the wafer is placed over the edge of the polishing pad. Another problem is that this approach has minimal flexibility in fine tuning the removal rate over the entire surface of the wafer.

Another attempted solution is to use a multizone carrier. Multizone carriers have a central zone and one or more concentric zones for altering the polishing rate for corresponding concentric zones on the wafer. Each of the zones in the carrier may be configured to apply an individually controllable pressure on the back surface of the wafer. In this way, concentric bands that are polishing too quickly or too slowly on the front surface of the wafer may receive a correcting lower or higher pressure on the back surface of the wafer by the multizone carrier. This approach adds more flexibility to the process, but also adds a great deal of expense and complexity to the process.

What is needed is a method and apparatus for uniformly planarizing a wafer that avoids the problems of the prior art. The solution needs to provide flexibility to the planarization process to correct for nonuniform polishing, while remaining simple and cost-effective.

SUMMARY OF THE INVENTION

The present invention is an apparatus and method for controlling the distribution of slurry across a polishing pad during a chemical mechanical polishing process. The invention allows the removal rate of material from different areas on the front surface of the wafer to be improved by adjusting the distribution of slurry across the polishing pad. Adjustments may be made before or during the planarization process. An object of the invention is to provide a method and apparatus that may be used to alter the removal rate of material from the front surface of the wafer to compensate for nonuniform planarization results. Another object of the invention is for the invention to be simple and inexpensive while avoiding the problems of the prior art.

The apparatus includes a slurry distribution system for controlling the distribution of slurry on a top surface of a polishing pad in a polishing station. The polishing station is used to planarize the front surface of a wafer. The slurry distribution system includes a polishing pad supported by a perforated platen. The polishing pad and platen may have aligned perforations to facilitate the transportation of slurry through them. A perforated top manifold may be positioned beneath the platen. The perforated top manifold may be juxtaposed with the platen, but a small gap preferably exists between the platen and the top manifold thereby creating a smoothing plenum. A perforated bottom manifold may be juxtaposed with the top manifold. A slurry chamber defining a slurry reservoir may be positioned beneath the bottom manifold.

The top and bottom perforated manifolds may be used to control the distribution of slurry across the polishing pad. By moving either the top or bottom manifold by a motor, a different pattern of aligned perforations may be created. By creating a pattern having a desired concentration of perforations in particular areas across the surface of the polishing pad, a desired concentration of slurry may be distributed to each area. The shape, size, position, and relationship of the perforations in the top and bottom manifolds may be selected to assist in making a wide range of adjustments to the slurry distribution across the polishing pad.

A slurry tank may be used for holding slurry for one or more chemical mechanical polishing tools. A pump may be used to communicate slurry from the slurry tank along a fluid communication path to the slurry reservoir. The pump, possibly in combination with one or more valves in the fluid communication path, may be used to control the volume of fluid delivered to the top surface of the polishing pad.

In a preferred embodiment, the platen is connected to an orbital motion generator. Orbital motion of the polishing pad during the planarization process with the described slurry delivery system is desirable (but not mandatory) for several reasons. Polishing pads used on orbital polishing stations tend to be smaller than on other types of polishing stations and are typically only slightly larger than the wafer. Smaller polishing pads make it easier to match areas on the front surface of the wafer that correspond with the areas on the polishing pad that they are polished against. However, other types of polishing stations, e.g. linear, rotational, etc., may also be used.

In operation, a desired distribution of slurry across a polishing pad may be achieved by moving, preferably rotating, either a perforated top manifold or a perforated bottom manifold to create a desired pattern of aligned perforations. Slurry may be transported from a slurry tank through the aligned perforations in the top and bottom manifolds to a top surface of the polishing pad. By moving the manifolds in relation to each other, a different pattern of aligned perforations may be created having different concentration of perforations. Areas on the polishing pad above areas of the manifolds having more perforations will have greater slurry flow than areas on the polishing pad above areas of the manifolds having fewer perforations. Applicant has noticed that areas on the polishing pad having greater slurry flow will produce faster material removal rates on the front surface of the wafer.

In another embodiment of the invention, a metrology instrument may be used to measure the surface of the wafer either during or after the planarization process. Metrology instruments, for example end-point detection systems, are known in the art. If measurements are taken during the planarization process, the slurry distribution across the polishing pad may be altered during the planarization process to correct for nonuniform planarization of the wafer. That is, areas on the polishing pad in contact with areas on the wafer polishing too quickly/slowly may receive less/more slurry. In determining this improved slurry distribution, many factors, such as the type of slurry, type of polishing pad, and material on the front surface of the wafer being planarized will need to be considered. In addition, the downforce and relative motion between the wafer and the polishing pad may also need to be considered in determining the improved slurry distribution. Computer modeling and empirical methods may be used to predict the improved slurry distribution needed based on these factors.

The results of the measurements taken during the planarization process may also be used to adjust the initial slurry distribution for the next wafer to be planarized. Measurements may also be taken by an inline or stand alone metrology instrument after the wafer has finished the planarization process. One advantage of waiting to take the measurements after the planarization process is that it is much easier to take measurements outside the harsh planarization process. Another advantage is that more time may be spent taking the measurements resulting in very accurate measurements. However, by taking the measurements after the planarization process, the results of the measurements will generally not be used for the benefit of the wafer being measured.

BRIEF DESCRIPTION OF THE DRAWINGS

The present invention will hereinafter be described in conjunction with the appended drawing figures, wherein like numerals denote like elements, and.

DETAILED DESCRIPTION OF EXEMPLARY EMBODIMENTS

An improved method and apparatus utilized in the polishing of semiconductor substrates and thin films formed thereon will now be described. In the following description, numerous specific details are set forth illustrating Applicant's best mode for practicing the present invention and enabling one of ordinary skill in the art to make and use the present invention. It will be obvious, however, to one skilled in the art that the present invention may be practiced without these specific details. In other instances, well-known machines and process steps have not been described in particular detail in order to avoid unnecessarily obscuring the present invention.

Figure 4:
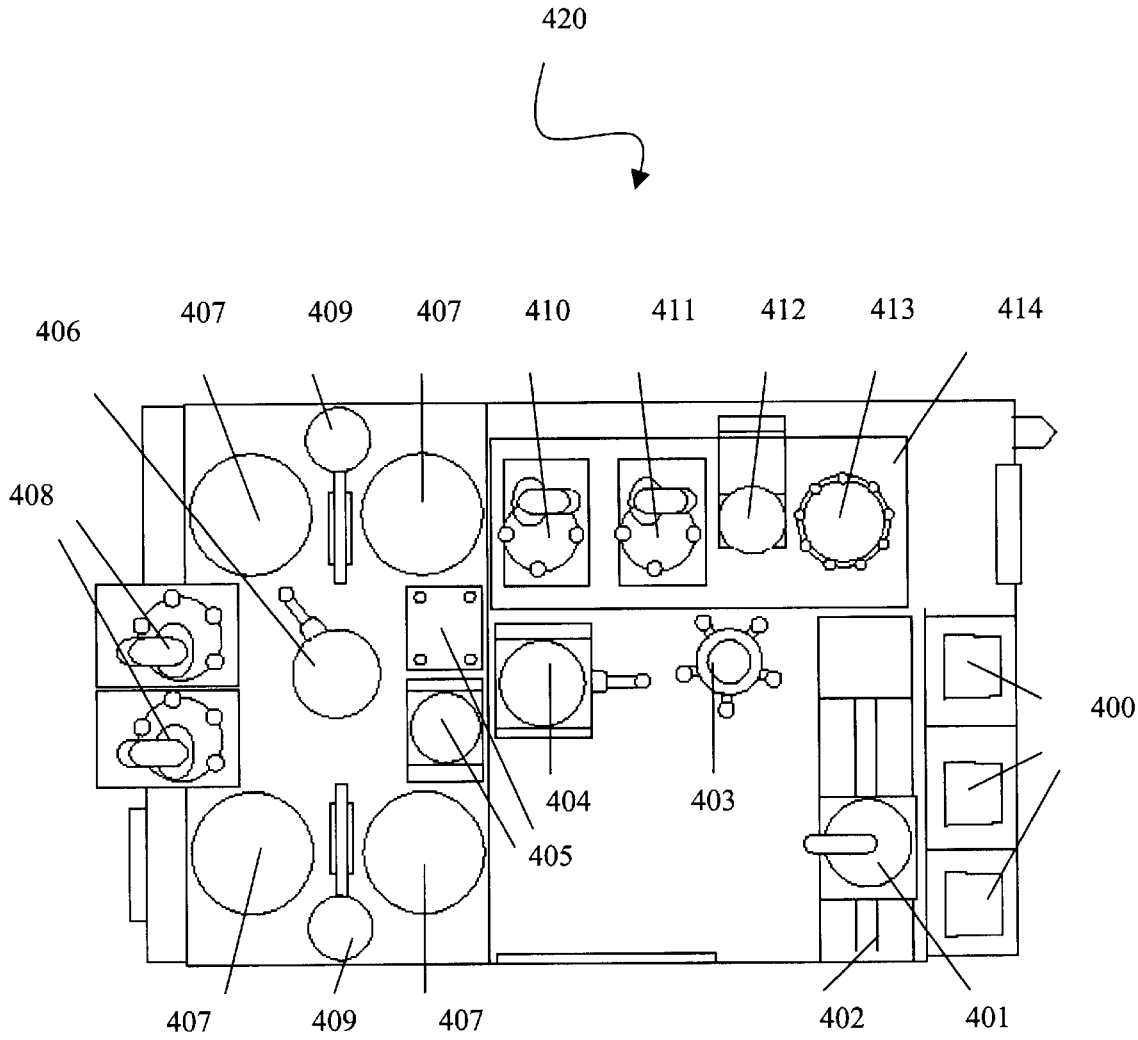
FIG. 4 is a plan view of a layout of a chemical mechanical polishing tool.

The invention may be practiced with a chemical mechanical polishing (CMP) tool as shown in FIG. 4. The general design of the CMP tool 420 is similar to a 776 model sold by SpeedFam-IPEC headquartered in Chandler, Ariz. One or more cassettes 400 loaded with wafers (not shown) may be loaded onto the CMP tool 420. A first robot 401 may slide along a track 402 as it removes wafers from the cassettes 400 and loads them into a holding station 403. A second robot 404 may take the wafer from the holding station 403 and place the wafer in one of two positions in a wet bath 405. A third robot 406 may remove the wafer from the wet bath 405 and transport the wafer to a carrier (shown in FIG. 1) associated with one of the four polishing stations 407.

Figure 1:
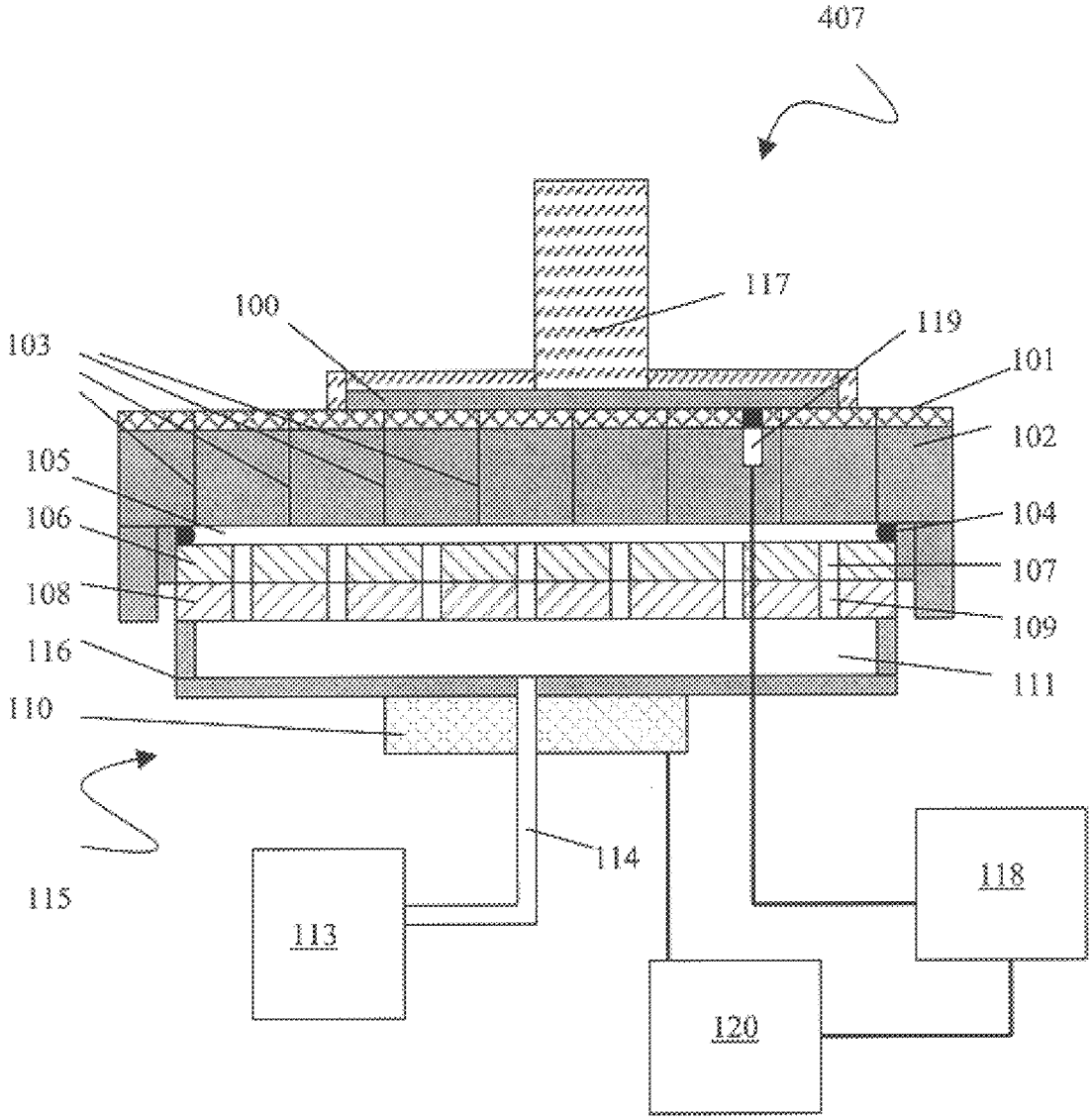
FIG. 1 is a cross section view of a slurry distribution system for a polishing station of a chemical mechanical polishing tool.
Figure 2:
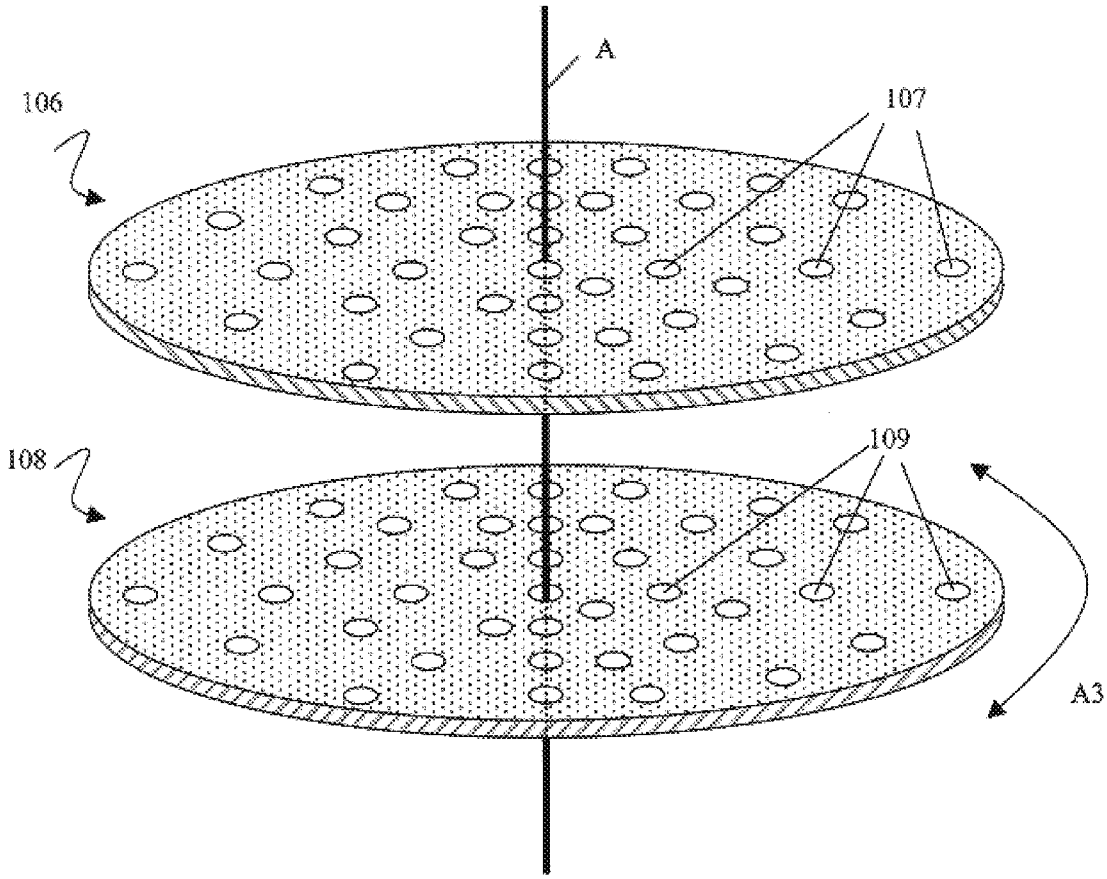
FIG. 2 is an exploded perspective view of a portion of the slurry distribution system, i.e. the top and bottom manifolds.

A cross section of one possible embodiment of a polishing station 407 is illustrated in FIG. 1. A carrier 117 may press a wafer 100 against a polishing pad 101 of the polishing station 407 as relative motion is created between the front surface of the wafer 100 and the polishing pad 101. A variety of polishing pads 101 may be used to practice the invention. The polishing pads 101 typically comprise a urethane based material. Examples of conventional polishing pads 101 that may be used with the invention are an IC1000 or an IC1000 supported by a Suba IV polishing pad. Both of these polishing pads 101, as well as others, are manufactured and made commercially available by Rodel Inc. with offices in Phoenix, Ariz. The particular polishing pad 101 selected for use may be selected based on the material and condition of the front surface of the wafer 100 and the desired planarization result.

Slurry may be introduced between the wafer 100 and the polishing pad 101 with a slurry distribution system 115. Slurry that is reactive with the material of the front surface of the wafer may be used to enhance the removal rate of the material across the front surface of the wafer 100. Various slurries are known in the art and may be selected based on the material to be removed and desired planarization results as is known in the art. Typical slurries are SSW2000 for removing tungsten or SS12 for removing oxide; both manufactured by Cabot Microelectronics, headquartered in Aurora, Ill. The slurry and deionized water may also be used to flush away debris from the top surface of the polishing pad 101 to limit the loading of material in the polishing pad 101. Also, a fluid, such as deionized water, may be delivered through the platen 102 and polishing pad 101 during the conditioning of the polishing pad 101 to assist in flushing the material loaded in the polishing pad 101 away.

The slurry starts in a slurry tank 113 that has means, e.g. a pump, gravity feed, etc., to transport the slurry through a fluid path 114 into a slurry reservoir 111 within a slurry chamber 116. The slurry must pass through holes 109 in the bottom manifold 108 that are aligned with holes 107 in the top manifold 106 to reach a narrow smoothing plenum 105. The size and shape of the holes in the manifolds may vary to assist in controlling the distribution of slurry. The concentration of holes in each manifold may range from about 0.4 to 10 holes per square inch and is preferably about 2 holes per square inch. Each hole may have an area between about 0.3 and 20 $mm^2$ and is preferably about 0.5 $mm^2$. While only a bottom 108 and top 106 manifold are shown in the illustrated embodiment, additional manifolds may also be used to give additional control over the flow of slurry through the manifolds. An o-ring 104 may be used to create the gap needed by the smoothing plenum or to prevent slurry from escaping along the periphery of the top manifold 106.

The smoothing plenum 105 smoothes out the distribution of slurry caused by the discrete locations of the aligned holes 107 and 109 in the bottom 108 and top manifold 106. The smoothing plenum 105 should be narrow or the desired slurry distribution caused by the aligned holes 107 and 109 will be lost. However, the smoothing plenum 105 should not be too narrow or areas between the aligned holes 107 and 109 will have an insufficient amount of slurry. The imaging or averaging of the aligned holes may thus be adjusted by changing the depth of the smoothing plenum 105. The optimum width of the smoothing plenum 105 will depend on many factors such as the viscosity of the slurry, slurry flow rate, speed and direction the smoothing plenum 105 is moved, and level of desired smoothing of the slurry. The optimum width will vary for each slurry distribution system 115 designed and need to be adjusted based on these and other factors. Typical values for the smoothing plenum 105 will generally be less than 20 mm and more than 0.2 mm and is preferably about 2.5 mm high. The slurry in the smoothing plenum 105 may pass through holes 103 in the platen 102 and corresponding holes in the polishing pad 101 to be deposited on the polishing pad 101. The concentration of the holes in the platen may be between about 0.2 and 5 holes per square inch and is preferably about 1 hole per square inch. The holes in the platen may be between about 0.2 and 5 mm in diameter and are preferably about 1 mm in diameter.

The distribution of slurry on the polishing pad 101 will be influenced by many factors. A few examples include the viscosity of the slurry, width of the smoothing plenum 105, size, number and placement of the holes 103 in the platen, properties of the polishing pad material, motion of the platen 102, and flow rate from the pump in the slurry tank 113. These factors will generally be fixed or not allow a controlled adjustment of the slurry distribution once the slurry distribution system 115 has been built.

A method in which adjustments may be made to the slurry distribution will now be discussed with reference to FIGS. 2, 3*a*, 3*b*, and 6. The invention allows the slurry distribution to be controlled by the number, size, shape, location and interrelationship between the holes 107 and 109 in the bottom 108 and top 106 manifolds. A motor 110 may be used to move, preferably rotate around axis A, either the bottom 108 or top 106 manifold as shown by arrow A3 for the bottom manifold 108 or arrow A6 for the top manifold 106. Movement of the bottom 108 or top 106 manifold will change the alignment of the holes 107 and 109 and thus change the slurry distribution across the top surface of the polishing pad.

It is desirable to select the number, size, shape and location of the holes 109 and 107 in the bottom 108 and top 106 manifolds that allow for an initial hole alignment pattern that creates an initially desired slurry distribution. Strategic placement of the holes 109 and 107 also allows different degrees of rotation of one of the manifolds to increase and/or decrease the slurry distribution in one or more regions on the polishing pad.

Figure 3A:
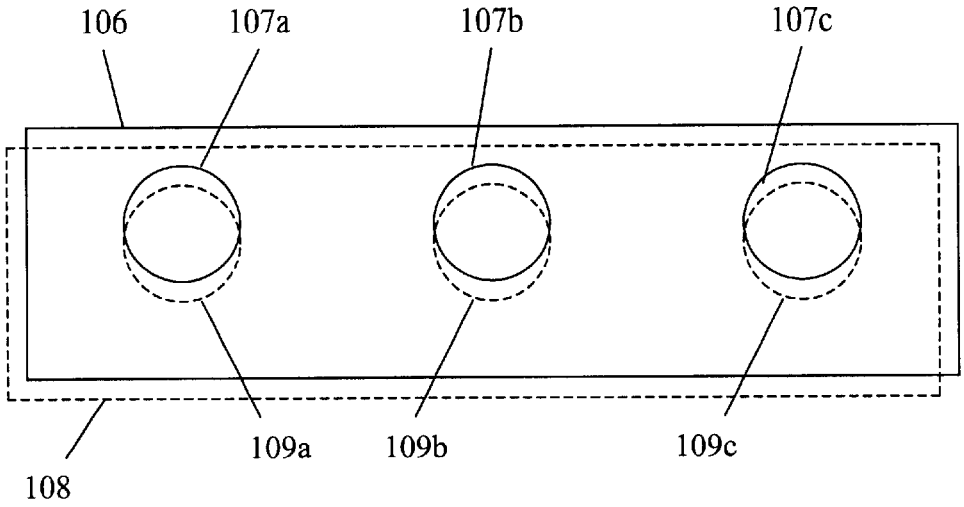
FIGS. 3*a* and 3*b* are plan views of a section of the top and bottom manifolds.
Figure 3B:
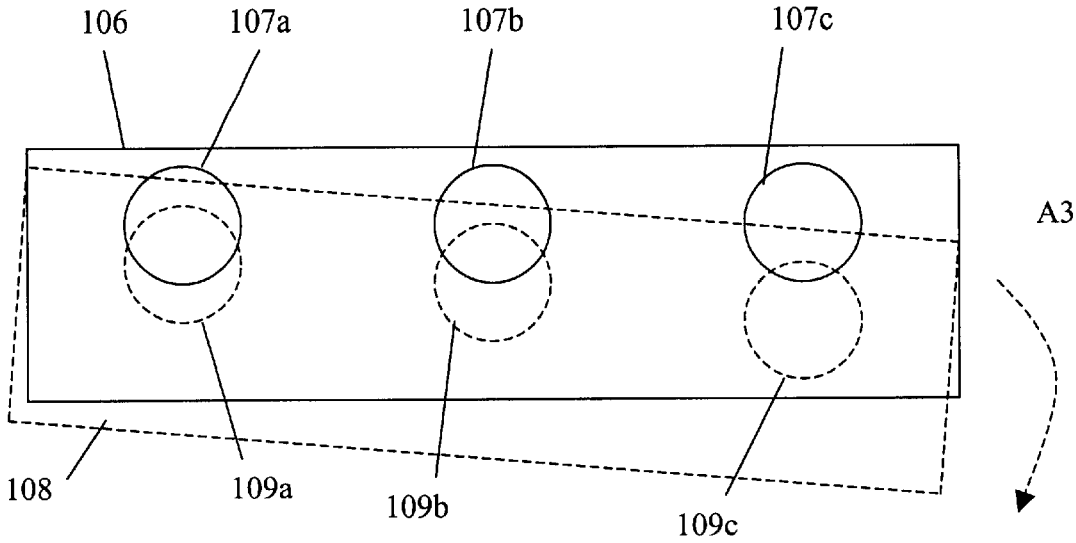

FIGS. 3*a* and 3*b* illustrate how the slurry distribution may be changed by rotating the bottom manifold 108 and corresponding holes 109*a*, 109*b* and 109*c* along arrow A3 in relation to the top manifold 106 and corresponding holes 107*a*, 107*b*, and 107*c*. In a possible starting position illustrated in FIG. 3*a*, holes 109*a*, 109*b*, and 109*c* substantially align with corresponding holes 107*a*, 107*b*, and 107*c*. This initial position produces a substantially uniform amount of slurry flow through each of the aligned pairs of holes. However, as the bottom manifold 108 is rotated along arrow A3 as shown in FIG. 3*b*, holes 109*a*, 109*b*, and 109*c* no longer substantially align with corresponding holes 107*a*, 107*b*, and 107*c*. The misalignments between the holes will reduce the amount of slurry allowed to pass through the holes. Not only will the amount of slurry be reduced, but it will be reduced in a predictable nonuniform manner. The reduction in slurry increases the further from the center axis of the bottom 108 and top 106 manifolds for this particular hole pattern shown. The relative movement between corresponding holes in the bottom 108 and top 106 manifold increases the further the holes are from the center axis. This fact should be accounted for when selecting the number, size, shape and location of the holes 109 and 107 in the bottom 108 and top 106 manifolds.

Figure 6:
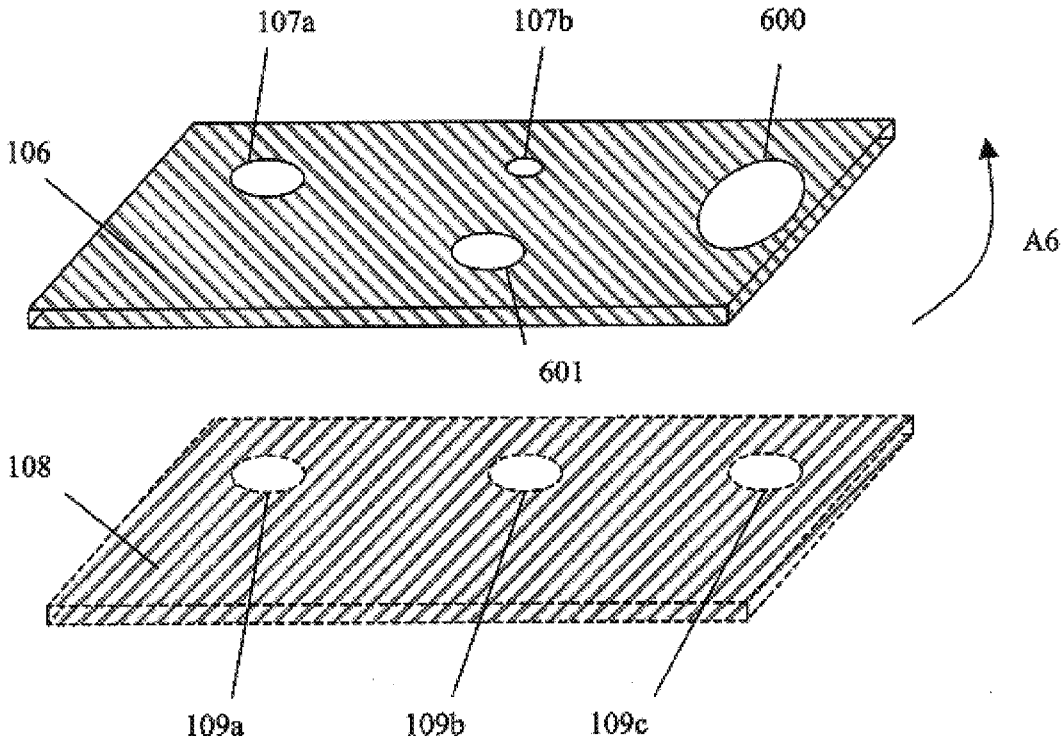
FIG. 6 is a perspective view of a section of the top and bottom manifolds.

FIG. 6 shows how the size, shape and location of the holes in the bottom 108 and top 106 manifolds may be selected to add additional control over the slurry distribution. Hole 107*b* has been made smaller relative to the other holes thereby reducing the amount of slurry that will flow through hole 107*b* and corresponding hole 109*b*. Hole 600 has been made larger relative to the other holes and oblong. The increased size and shape allow for longer alignment with corresponding hole 109*c*, thereby increasing the amount of slurry the will flow through holes 600 and 109*c*. An additional hole 601 has been added to the top manifold 106. This hole 601 will align with a hole 109*b* in the bottom manifold 108 when the top manifold 106 is rotated along arrow A6 a particular distance. The additional hole 601 allows for additional slurry in corresponding regions when the manifolds have been rotated to particular positions. By varying the size, shape and location of the holes, different slurry distributions may be achieved by simply rotating one of the manifolds.

Referring back to FIG. 1, metrology instruments 118 are known in the art for taking measurements of the front surface of a wafer 100 during, or after, the planarization process. For measurements made during the planarization process, a probe 119 may be inserted into the platen 102 so that the wafer 100 passes over the probe 119. These systems use a wide range of technologies to take measurements with common examples including lasers or multi-frequency optic systems. The metrology instrument 118 may be used to measure film thickness, removal rate, uniformity or other characteristics of the wafer 100. This information may be used to determine if alterations to the distribution of slurry should be performed. The metrology instrument is preferably an endpoint detection system. For example, a Sentinel model endpoint detection system manufactured by SpeedFam-IPEC Corporation headquartered in Chandler, Ariz. using components manufactured by Verity Instruments, Inc. headquartered in Carrollton, Tex. may be used to take measurements during the planarization process. The results of the measurements are preferably communicated to a computer 120. The computer 120 may be used to determine if improved planarization results may be obtained if one of the manifolds 106 or 108 is rotated and how far the manifold should be rotated. The computer 120 may then communicate this information to the motor 110 controlling the rotation of the manifold.

The relative motion between the front surface of the wafer 100 and the polishing pad 101 is preferably created by holding the front surface of the wafer 100 in a carrier 117 stationary while the polishing pad 101 is orbited. The polishing pad 101 may be supported by a rigid platen 102. The platen 102 preferably comprises a rigid noncorrosive material such as titanium, ceramic or stainless steel.

Figure 5:
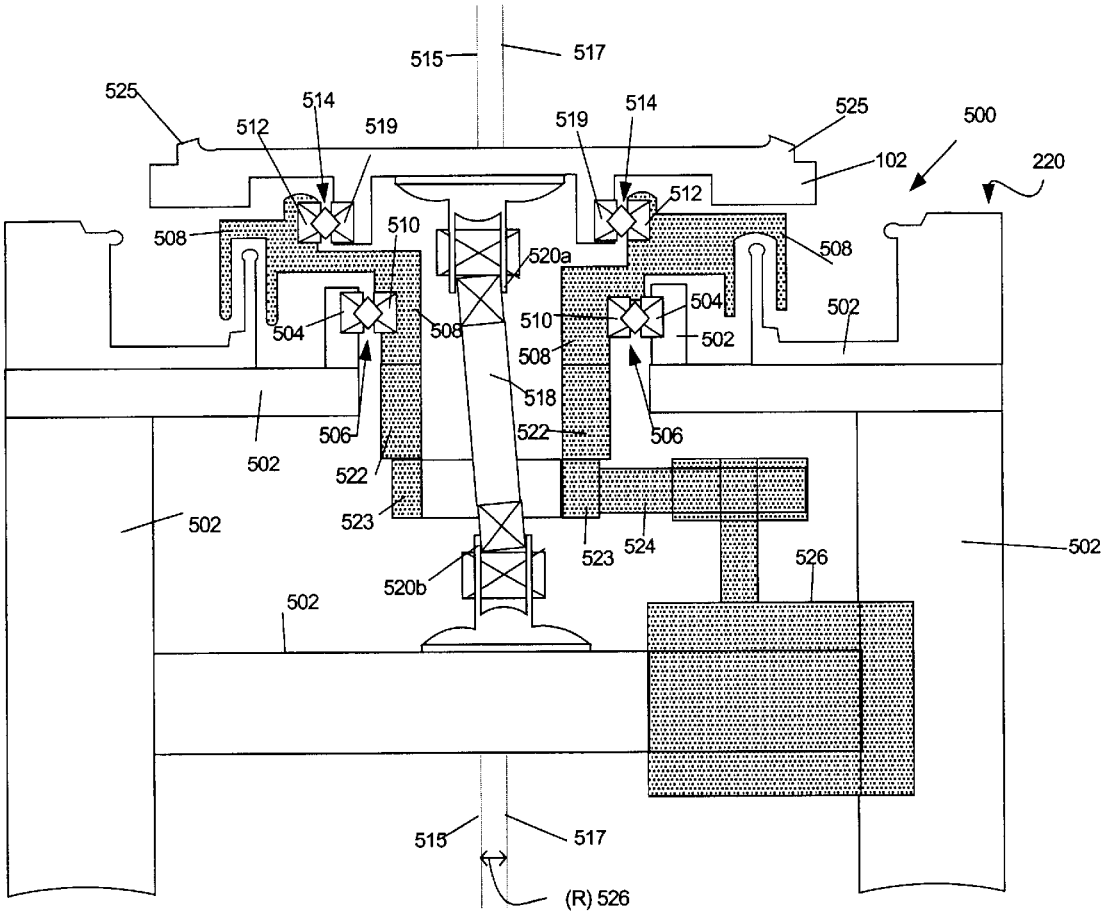
FIG. 5 is a cross section view of an orbital motion generator for a polishing station of a chemical mechanical polishing tool.

FIG. 5 is a cross-sectional view of an exemplary motion generator 500 that may be used to generate an orbital motion for the platen 102. The motion generator 500 is generally disclosed in U.S. Pat. No. 5,554,064 Breivogel et al. and is hereby incorporated by reference. Supporting base 220 may have a rigid frame 502 that can be securely fixed to the ground. Stationary frame 502 is used to support and balance motion generator 500. The outside ring 504 of a lower bearing 506 is rigidly fixed by clamps to stationary frame 502. Stationary frame 502 prevents outside ring 504 of lower bearing 506 from rotating. Wave generator 508 formed of a circular, hollow rigid body, preferably made of stainless steal, is clamped to the inside ring 510 of lower bearing 506. Wave generator 508 is also clamped to outside ring 512 of an upper bearing 514. Waver generator 508 positions upper bearing 514 parallel to lower bearing 506. Wave generator 508 offsets the center axis 515 of upper bearing 514 from the center axis 517 of lower bearing 506. A circular platen 102, preferably made of aluminum, is symmetrically positioned and securely fastened to the inner ring 519 of upper bearing 514. A polishing pad or pad assembly can be securely fastened to ridge 525 formed around the outside edge of the upper surface of platen 102. A universal joint 518 having two pivot points 520*a* and 520*b* is securely fastened to stationary frame 502 and to the bottom surface of platen 102. The lower portion of wave generator 508 is rigidly connected to a hollow and cylindrical drive spool 522 that in turn is connected to a hollow and cylindrical drive pulley 523. Drive pulley 523 is coupled by a belt 524 to a motor 526. Motor 526 may be a variable speed, three phase, two horsepower AC motor.

The orbital motion of platen 102 is generated by spinning wave generator 508. Wave generator 508 is rotated by variable speed motor 526. As wave generator 508 rotates, the center axis 515 of upper bearing 514 orbits about the center axis 517 of lower bearing 506. The radius of the orbit of the upper bearing 517 is equal to the offset (R) 526 between the center axis 515 of upper bearing 514 and the center axis 517 of the lower bearing 506. Upper bearing 514 orbits about the center axis 517 of lower bearing 506 at a rate equal to the rotation of wave generator 508. It is to be noted that the outer ring 512 of upper bearing 514 not only orbits but also rotates (spins) as wave generator 508 rotates. The function of universal joint 518 is to prevent torque from rotating or spinning platen 102. The dual pivot points 520*a* and 520*b* of universal joint 518 allow the platen 102 to move in all directions except a rotational direction. By connecting platen 102 to the inner ring 519 of upper bearing 514 and by connecting universal joint 518 to platen 102 and stationary frame 502 the rotational movement of inner ring 519 and platen 102 is prevented and platen 102 only orbits as desired. The orbit rate of platen 102 is equal to the rotation rate of wave generator 508 and the orbit radius of platen 102 is equal to the offset of the center 515 of upper bearing 514 from the center 517 of lower bearing 506. The platen 102 is preferably orbited with a radius between about 20 mm and 5 mm.

It is to be appreciated that a variety of other well-known means may be employed to facilitate the orbital motion of the platen 102. While a particular method for producing an orbital motion has been given in detail, the present invention may also be practiced using a variety of other motions for the platen 102. Examples of possible motions for the platen 102 include rotational, linear, oscillation clockwise and counterclockwise and various combinations of these motions. The invention is not limited to any particular motion of the platen 102 or carrier.

Referring back to FIG. 4, the third robot 406 may be used to transfer the wafer from the carrier in one of the polishing stations 407 to one of two buff stations 408. While the wafer is being buffed in one of the buff stations 408, the polishing pad in one or more of the polishing stations 407 may be conditioned by a polishing pad conditioner 409 sweeping across the surface of the polishing pad. After the wafer has been buffed at one of the buffing stations 408, the wafer may be transported by the third robot 406 back to one of the wet baths 405.

The second robot 404 may then remove the wafer from the wet bath 405 and transport the wafer to a first cleaning position 410 within a cleaning station 414. After an initial cleaning in the first cleaning position 410, a fourth robot 412 may transport the wafer to a second cleaning position 411. Cleaning positions 410 and 411 may be of types known in the art. The cleaning positions 410 and 411 may comprise a pair of opposing pancake shaped disks to clean a wafer there between or a plurality of pairs of opposing rollers aligned so that the wafer may be pulled between the rollers. After cleaning in cleaning positions 410 and 411, the fourth robot 412 will move the wafer to a drying unit 413. The drying unit 413 is preferably a spin drier that dries the wafer by rapidly spinning the wafer and removing the fluids on the wafer by centrifugal force. The dried wafer may be removed from the cleaning station 414 by the first robot 401 and replaced into one of the cassettes 400.

A detailed layout of one possible CMP tool has thus been described. Of course, many variations in the CMP tool design with, for examples, a different number of robots, polishing station and/or buffing stations or a different layout may also be used.

Figure 7:
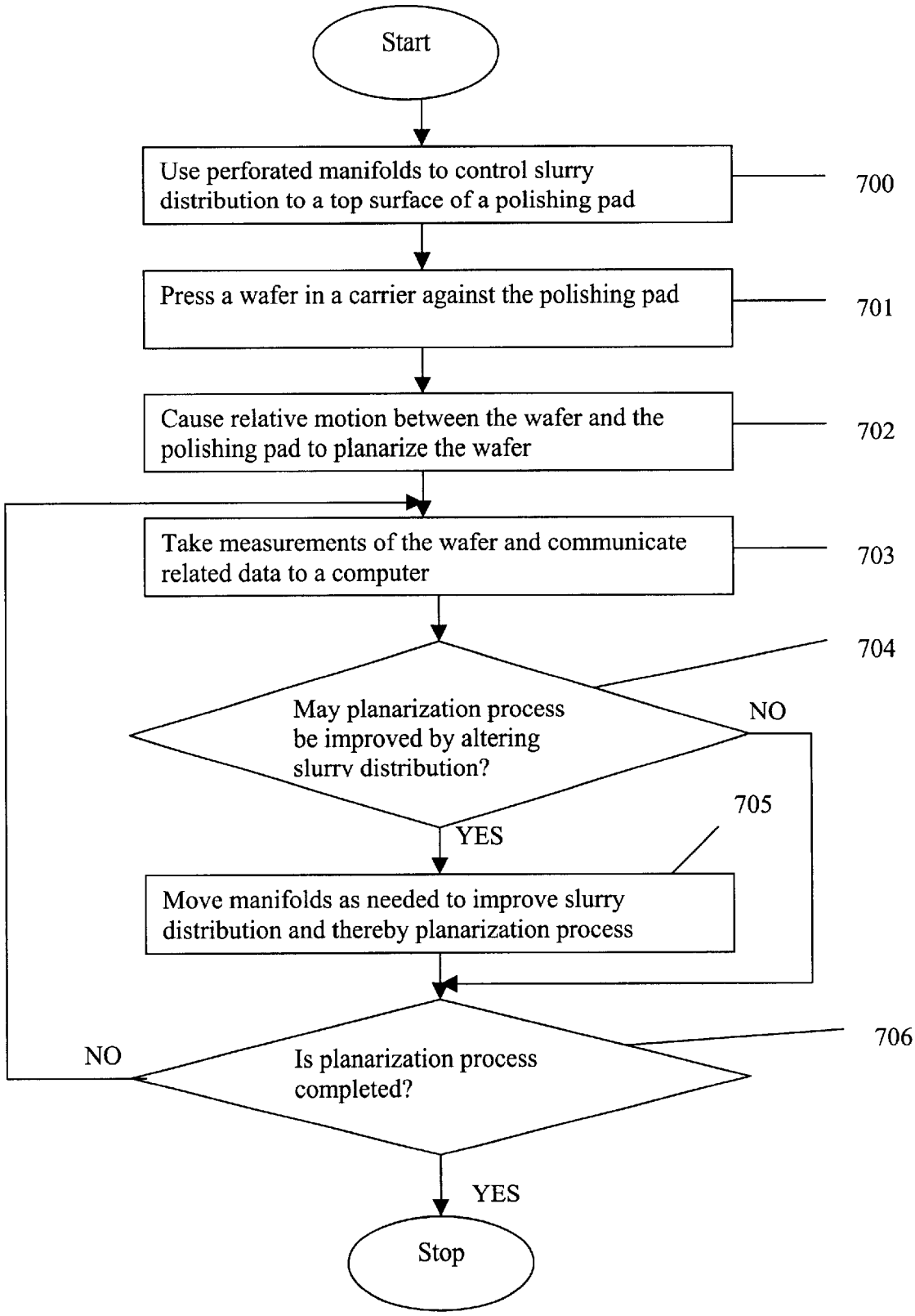
FIG. 7 is a flowchart illustrating a method of practicing the invention.

With continuing reference to FIGS. 1 and 7, one possible method out of many for practicing the present invention will now be discussed. Motor 110 may be used to properly position the bottom manifold 108 in relation to the top manifold 106 to create a desired pattern of overlapping holes 109 and 107. Slurry is communicated from the slurry tank 113 through the overlapping holes 109 and 107 to a smoothing plenum 105 if a smoothing plenum 105 is used. Holes 103 in the platen 102 and polishing pad 101 assist the slurry on its path from the smoothing plenum 105 to the top surface of the polishing pad 101. The pattern of overlapping holes will control the distribution of slurry to the top surface of the polishing pad. (Step 700) The greater the concentration of overlapping holes, the greater the flow of slurry there through.

A wafer 100 in a carrier 117 may then be pressed against the polishing pad 101. (Step 701) Relative motion may be created between the wafer 100 and the polishing pad 101 to begin removing material from the front surface of the wafer 100. (Step 702) In a particularly preferred embodiment, the carrier 117 is held stationary while the polishing pad is rapidly orbited at 600 rpms at a radius of 16 mm. In addition, the polishing pad 101 may also be oscillated clockwise and counter-clockwise plus and minus 270 degrees in combination with the orbital motion to planarize the wafer.

While the wafer 100 is being planarized, the topography and/or uniformity of the wafer 100 may be measured by a metrology instrument 118 with a probe 119 located beneath the wafer 100. The measurements taken may be communicated to a computer for analysis. (Step 703) The preferred method is to use an endpoint detection system as the metrology instrument 118. Applicant has noticed that the removal rate during the planarization process may be altered for particular areas on the front surface of a wafer 100. This may be accomplished by adjusting the slurry distribution on the polishing pad 101 at the wafer-polishing pad interface. The measured topography of the front surface of the wafer 100 may be analyzed and areas that need an increase or decrease in removal rate may be determined.

An increase in slurry distribution may generally be used to increase the removal rate of material in areas that are polishing too slowly. Likewise, a decrease in slurry distribution may generally be used to decrease the removal rate of material in areas that are polishing too quickly. The amount of adjustment necessary for the slurry distribution will vary depending on the particular workpiece being planarized and other polishing parameters. The effect of varying the slurry distribution will generally need to be found empirically for each workpiece and planarization process. If needed, the slurry distribution may be adjusted by a computer 120 altering a motor 110 in a manner that will result in an improved planarization process. (Step 704) Specifically, the bottom manifold 108 may be rotated to increase the slurry distribution to areas that are polishing too slowly and/or to decrease the slurry distribution to areas that are polishing too quickly. (Step 705) The process of taking measurements and refining the slurry distribution may be repeated until the desired amount of material has been removed from the wafer 100 at which time the planarization process may be terminated. (Step 706)

One alternative approach is to measure the front surface of the wafer 100 after the planarization process has been completed. This method allows for very accurate measurements of the wafer 100 and for the data to be used in adjusting the slurry distribution for following wafers 100. However, this method does not allow the results to be used to improve the planarization process of the wafer 100 measured.

While the invention has been described with regard to specific embodiments, those skilled in the art will recognize that changes can be made in form and detail without departing from the spirit and scope of the invention. For example, specific dimensions for desired concentrations and sizes of holes for the manifolds and platen have been given in order to enable one of ordinary skill to make and use the invention. However, the number and dimensions of the holes may be changed without departing from the scope and breadth of the invention. The scope and breadth of the invention is defined in the claims.

I claim:

1. A slurry distribution system for controlling the distribution of a slurry on a top surface of a polishing pad in a polishing station comprising:

a) a polishing pad;

b) a perforated platen supporting the polishing pad;

c) a perforated top manifold positioned beneath the platen;

d) a perforated bottom manifold juxtaposed with the top manifold;

e) a slurry chamber defining a slurry reservoir beneath the bottom manifold; and f) a motor for rotating either the top or bottom manifold.

2. The slurry distribution system of claim 1, further comprising:

g) a slurry tank for holding slurry;

h) a fluid communication path from the slurry tank to the slurry reservoir; and i) a pump for communicating the slurry along the fluid communication path.

3. The slurry distribution system of claim 1, wherein a smoothing plenum is created between the platen and top manifold.

4. The slurry distribution system of claim 3, wherein the smoothing plenum is less than 10 mm in height.

5. The slurry distribution system of claim 3, wherein the smoothing plenum is about 2.5 mm in height.

6. The slurry distribution system of claim 1, wherein the top manifold is juxtaposed with the platen.

7. The slurry distribution system of claim 1, further comprising an orbital motion generator connected to the platen.

8. A method of controlling a distribution of slurry across a polishing pad in a polishing station comprising the steps of:

a) moving either a perforated top manifold or a perforated bottom manifold thereby creating a desired pattern of aligned perforations; and b) transporting a slurry through the aligned perforations to a top surface of a polishing pad during a planarization process of a wafer, wherein the aligned perforations produce a desired distribution of slurry on the polishing pad.

9. The method of claim 8 wherein moving either the top or bottom manifold comprises rotating either the top or bottom manifold.

10. The method of claim 8 wherein the perforations in the top and bottom manifolds are designed to allow an adjusted slurry distribution to the top surface of the polishing pad to be created by moving either the top or bottom manifold.

11. The method of claim 8 further comprising the steps of:

c) measuring a front surface of the wafer during the planarization process;

d) determining where an increase or decrease in material removal rate on the front surface of the wafer would improve the planarization process;

e) determining an adjusted slurry distribution over the polishing pad that would substantially produce the improved the planarization process; and f) moving either the top or bottom manifold during the planarization process to substantially produce the adjusted slurry distribution to the top surface of the polishing pad.

12. The method of claim 8 further comprising the steps of:

c) measuring a front surface of the wafer after the planarization process;

d) determining where an increase or decrease in material removal rate on the front surface of the wafer would improve a second planarization process of a second wafer;

e) determining an adjusted slurry distribution over the polishing pad that would substantially produce the improved second planarization process; and f) moving either the top or bottom manifold at the start of the second planarization process to substantially produce the adjusted slurry distribution to the top surface of the polishing pad for the second planarization process of the second wafer.

* * * * *